US005860454A

United States Patent [19]

Mista et al.

[11] Patent Number: 5,860,454

[45] Date of Patent: Jan. 19, 1999

[54] ELECTROMAGNETICALLY-OPERATING JACQUARD CONTROL DEVICE

[75] Inventors: Kresimir Mista, Heusenstamm; Hans-Jurgen Hohne, Hainburg, both of Germany

[73] Assignee: Karl Mayer Textilmachinenfabrik GmbH, Obertshausen, Germany

[21] Appl. No.: 985,694

[22] Filed: Dec. 5, 1997

[30] Foreign Application Priority Data

Dec. 10, 1996 [DE] Germany ..... 196 51 190.9

[51] Int. Cl.[6] ..... D03D 13/00

[52] U.S. Cl. ..... 139/455; 139/68; 139/71; 66/219; 66/220

[58] Field of Search ..... 139/455, 71, 68; 156/636; 428/652; 324/318; 66/219, 220

[56] References Cited

U.S. PATENT DOCUMENTS

| | | | |
|---|---|---|---|
| 4,224,381 | 9/1980 | Patel et al. | 428/652 |
| 4,645,561 | 2/1987 | Rea | 156/636 |
| 4,702,286 | 10/1987 | Palau et al. . | |
| 5,002,099 | 3/1991 | Seiler | 139/455 |
| 5,018,556 | 5/1991 | Yoshida et al. | 139/68 |
| 5,070,911 | 12/1991 | Patel et al. | 139/71 |
| 5,275,211 | 1/1994 | Roth | 139/455 |
| 5,481,191 | 1/1996 | Rzedizian | 324/318 |

FOREIGN PATENT DOCUMENTS

| | | |
|---|---|---|
| 0045759 | 2/1981 | European Pat. Off. . |
| 0697477 | 1/1995 | European Pat. Off. . |
| 0108700 | 11/1983 | Germany . |
| 4028390A | 3/1992 | Germany . |
| 2247694 | 8/1991 | United Kingdom . |

OTHER PUBLICATIONS

United Kingdom Search Report, Feb. 23, 1998.

*Primary Examiner*—Lincoln Donovan
*Assistant Examiner*—Richard Kyung Lee
*Attorney, Agent, or Firm*—Omri M. Behr, Esq.

[57] ABSTRACT

An electromagnetically-operating Jacquard control device has an electromagnet (1) with a magnetic core (3), an armature (8) and a limit stop (14) for each controlling element (16) to be controlled. The limit stop can optionally be brought into the movement path of a hook (18) attached to the controlling element (16). Two lovers (5, 11) are provided, the first bearing the armature (8) and the second bearing the limit stop (14). These two levers are coupled to one another with positive engagement such that the forces are transmitted substantially perpendicularly to the plane formed by the limit stop (14) and the swivel pin (12) of the second lever (11). This enables wear-related incorrect operation to be avoided.

15 Claims, 1 Drawing Sheet

ELECTROMAGNETICALLY-OPERATING JACQUARD CONTROL DEVICE

BACKGROUND OF THE INVENTION

1. Field of the Invention

The present invention relates to an electromagnetically-operating Jacquard control device, wherein each controlling element to be controlled has an electromagnet with a magnetic core, an armature pivotable about a swivel pin, and a limit stop, which is located in the movement path of a hook attached to the controlling element when the armature is attracted and is outside this movement path when the armature is released, and in particular to device having a plate that is periodically driven to and fro and abuts the magnetic core in one end position of the armature, preventing the hook from avoiding engagement with the limit stop.

2. Description of Related Art

Such a Jacquard control device is known from DE 40 28 390 A1. That device uses a two-arm angle lever which bears the armature on one arm and the limit stop on the other arm. This construction allows the use of small electromagnets arranged close to one another. This known device has been successfully deployed for slow-running machines, but can result in incorrect operation at higher speeds.

The aim of the present invention is to disclose a Jacquard control device of the above-mentioned type which operates reliably at all machine speeds.

This aim is met in accordance with the invention in that two levers are provided, the first bearing the armature and the second bearing the limit stop, and are coupled to one another with positive engagement in such a manner that the forces are substantially transferred perpendicularly to the plane formed by the limit stop and the swivel pin of the second lever.

SUMMARY OF THE INVENTION

In accordance with the illustrative embodiments demonstrating features and advantages of the present invention, there is provided an electromagnetically-operating Jacquard control device, with a plurality of Jacquard means. These Jacquard means each have an electromagnet with a magnetic core, and an armature pivotally mounted about a pivot axis. The Jacquard means also has a controlling element with a hook, a first lever bearing the armature, and a second lever pivotally mounted about a swivel axis. The second lever has a limit stop. This limit stop Is located (i) in the movement path of the hook when the armature is attracted, and (ii) outside this movement path when the armature is released. The first and the second layers are coupled to each other with a positive engagement that transmits forces substantially perpendicularly to the plane formed by the limit stop and the swivel axis of the second lever. The control device also has a plate which is periodically reciprocated to cause the armature in one end position to abut the magnetic core and prevent the hook from avoiding engagement with the limit stop.

The rationale of this construction is that incorrect operation is attributable to wear on the opposing faces of the core and armature. The wear results in an increased remanence and thus a tendency to release the armature too late. The wear is ascribed in particular to a displacement movement between the armature and the magnetic core which occurs, with the armature attracted, when the hook suddenly hits the limit stop. During this sudden stop, not just the pressure force between the armature and magnetic core is increased, but also a force component is generated in the longitudinal direction of the armature due to the unavoidable bearing play.

The use of two levers in accordance with the invention, coupled to one another with positive engagement, results in a separation between the limit stop and the armature such that the forces transferred from the hook to the limit stop have practically no effect on the armature. The armature is solely pressed against the magnetic core with the aid of the driven plate and, depending on the pattern desired, can remain in this position or be released. Greater forces, especially those bringing about a transverse displacement of the armature, are no longer seen.

A favorable aspect of this construction is that the second lever is biased by a spring which holds the coupling areas on both levers against one another. The spring ensures that the two levers continuously follow one another.

From a construction perspective, it is recommended that the first lever be a two-arm angle lever, which bears the armature on its first arm and its coupling area on its second arm. It is further recommended that the second lever has a single arm, which runs approximately parallel to the second arm of the first lever and has its coupling area between the limit stop and the swivel pin. This yields a space-saving arrangement which is safe in operation.

It is especially advantageous for both levers to have a common swivel pin. This simplifies construction.

In a preferred embodiment it is ensured that the armature and/or the front face of the magnetic core bears a thin layer of non-magnetic material. This layer allows the remanence to be kept low. The layer may in particular be of chemically-applied nickel. The layer thickness is preferably 5 to 30 $\mu$m and is optimally just approximately 10 $\mu$m. Such a layer is especially sensitive to wear since just a very minor degree of abrasion will result in a considerable increase in remanence end thus to incorrect operation as a result of the armature being released too late. This danger is avoided through the use of two levers coupled with positive engagement. The thin layer retains its original strength over a long working life.

As a further improvement it is expedient to secure the armature, using a curable filling compound, in a position on the first lever which results from pressing against the magnetic core. The optimal position of the armature for subsequent operation can then be specified prior to curing of the filling compound.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
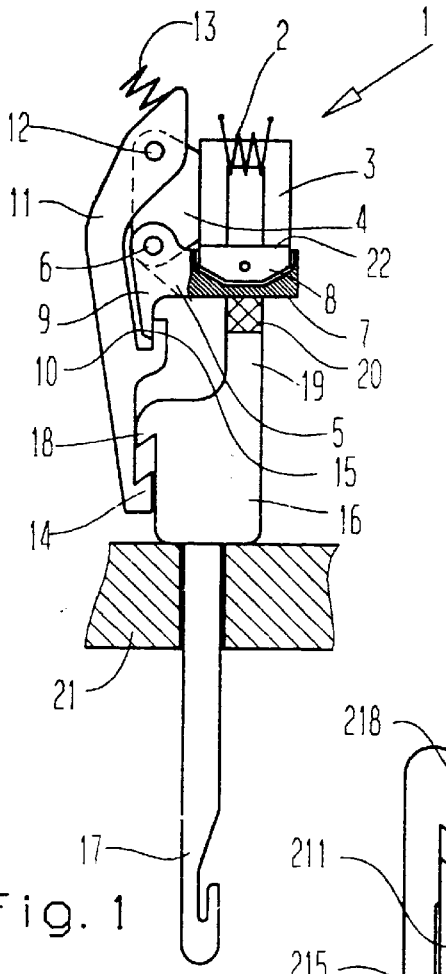
FIG. 1 is a schematic representation of an electromagnetically-operating Jacquard control device in accordance with the invention.

FIG. 1 shows an electromagnet 1 with a winding 2 on a U-shaped magnetic core 3 which is mounted on a frame 4 and is part of a Jacquard means. A first lever 5 (also part of the Jacquard means), which can pivot about a swivel pin 6 (also referred to as a pivot axis), has a first arm 7 which bears an armature 8 and a downwardly-facing second arm 9, arranged at an angle thereto and bearing a coupling areas 10. A second lever 11 (part of the Jacquard means), which can pivot about a swivel axis provided by swivel pin 12. Second lever 11 is subject to the load of a compression spring 13, and bears a limit stop 14 on its free end and a coupling area 15 between this limit stop and the swivel pin 12.

A controlling element 16 (part of the Jacquard means), has an output element 17 below for connection to a harness cord or the like. Element 16 bears a hook 18, which can optionally engage with the limit stop 14 or be moved past it. Controlling element 16 is provided with an extension 19 which can press against the first arm 7 of the first layer 5 under the intermediate switching of an elastic element 20, for instance a strip of elastic material extending beyond the width of the Jacquard control device. A plate 21 is driven up and down and engages below on the controlling element 16.

When the plate 21 is upwardly-displaced in the position shown in FIG. 1, the armature 8 is pressed against the magnetic core 3. If the electromagnet is excited then, the armature 8, the first lever 5 and the second lever 11 remain in the position shown. If the plate 21 is again moved downwards then the controlling element 16 can only follow till it abuts the limit stop 14. The controlling element 16 thus remains in an upper position. If, however, the electromagnet 1 is not excited, then the armature 8 falls again upon downward movement of the plate 21, as a result of which (a) the first lever 5 and the second lever 11 are swivelled in a clockwise direction due to the influence of the spring 13, (b) the limit stop 14 is removed from the movement path of the hook 18 and (c) the controlling element 16 is moved into its lower position, not shown.

When the hook 18 engages with the limit stop 14 then the forces introduced in the process are discharged via the swivel pin 12 into the frame 4. These forces cannot be transmitted via the positive coupling between the coupling areas 10 and 15 since the aforementioned forces do not have any component, or no pronounced component, perpendicular to the plane formed by the swivel pin 12 and the limit stop 14. The armature 8 therefore remains unaffected. Consequently, a thin layer 22 of non-magnetizable material between the armature 8 and the magnetic core 3 is thus not subjected to friction and wear. The remanence characteristic are retained throughout the whole working life.

The thin layer 22 comprises a non-magnetizable thin material, especially chemically-applied nickel, applied to the front face of the magnetic core and/or the armature. Plastics and other materials, however, can also be used. The layer thickness is exceptionally low, i.e., between 5 and 30 $\mu$m, especially approximately 10 $\mu$m. Even small changes would have an exceptionally strong effect on remanence. Such a material degradation is avoided in accordance with the invention.

The armature 8 is secured to the first lever 5 using a curable filling compound. To ensure that it retains its optimal operating position it is pressed against the magnetic core 3 until the filling compound has cured. This position of the armature is then retained throughout its working life.

Figure 2:
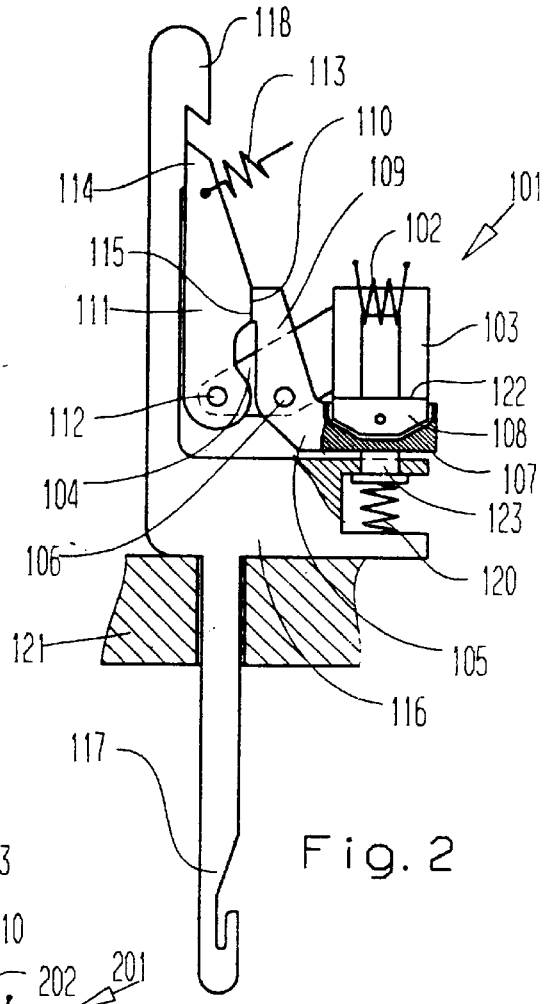
FIG. 2 is a schematic representation of an alternate embodiment thereof.

With the embodiment form shown in FIG. 2, the reference numbers are increased by 100 for the corresponding parts. The main difference is that the second arm 109 of the first lever 105 points upwards and is located next to the electromagnet 101. Further, the second lever 111 extends upwardly with the limit stop 114, as does the hook 118. Moreover, the spring 113 is a tension spring. The elastic element 20 is replaced in FIG. 2 by a supporting member 123 which is pressed by a spring 120 up to a limit stop.

Figure 3:
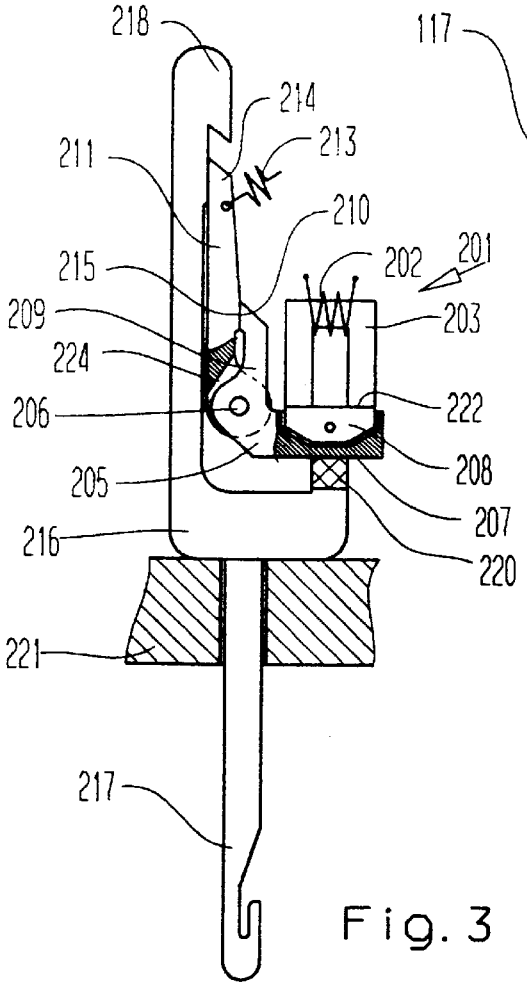
FIG. 3 is a schematic representation of a third embodiment thereof.

With the embodiment form shown in FIG. 3, the reference numbers are again increased by 100 for the corresponding parts. The main difference between this and the previous examples is that a common swivel pin 206 is provided for the first lever 206 and the second level 211. The first lever 205 engages in a corresponding recess 224 in the second lover 211 in the region of the swivel pin 206. The two coupling areas 210 and 215 are positioned just above the recess 224.

It is possible to depart from the example embodiments shown in several ways without deviating from the fundamental concept of the invention. For example, the output elements 17 can serve not just for attachment of the harness cords but can also take the form of plungers to allow specific operating elements, especially in knitting and weaving machines, to be optionally brought into one of two positions, for which DE 195 14 995 A1 shows exemplary embodiments.

Obviously, many modifications and variations of the present invention are possible in light of the above teachings. It is therefore to be understood that within the scope of the appended claims, the invention may be practiced otherwise than as specifically described.

We claim:

1. An electromagnetically-operating Jacquard control device, comprising:

a plurality of Jacquard means, each including:

(a) an electromagnet having a magnetic core;

(b) an armature pivotally mounted about a pivot axis;

(c) a controlling element having a hook;

(d) a first lever bearing the armature; and (e) a second lever pivotally mounted about a swivel axis and having a limit stop, the limit stop being located (i) in the movement path of the hook when the armature is attracted, and (ii) outside this movement path when the armature is released, the first and the second levers being coupled to each other with a positive engagement that transmits forces substantially perpendicularly to a reference plane formed by the limit stop and the swivel axis of the second lever, the limit stop when located in the movement path of the hook being operable to engage the hook in a manner hindering transmission of a substantial component of force perpendicular to the reference plane; and a plate which is periodically reciprocated to cause the armature in one end position to abut the magnetic core and prevent the hook from avoiding engagement with the limit stop.

2. A control device according to claim 1, wherein the first and the second levers engage each other through corresponding coupling areas, said control device comprising:

a spring means for biasing the second lever to urge together the coupling areas of the first and the second levers.

3. A control device According to claim 2, wherein the first lever is a dual-arm angle lever having a first arm bearing the armature and a second area bearing the coupling area of the first lever, the second lever having a single arm running approximately parallel to the second arm of the first lever, the coupling area of the second lever being located between the limit stop and the swivel axis.

4. A control device according to claim 1, wherein the first lever is a dual-arm angle lever having a first arm bearing the armature and a second area bearing the coupling area of the first lever, the second lever having a single arm running approximately parallel to the second arm of the first lever, the coupling area of the second lever being located between the limit stop and the swivel axis.

5. A control device according to claim 1, wherein the first and the second levers are commonly and pivotally mounted about the swivel axis.

6. A control device according to claim 2, wherein the first and the second levers are commonly and pivotally mounted about the swivel axis.

7. A control device according to claim 4, wherein the armature and the magnetic core have opposing faces and at least one of them includes a thin layer of non-magnetic material.

8. A control device according to claim 1, wherein the armature and the magnetic core have opposing faces and at least one of them includes a thin layer of non-magnetic material.

9. A control device according to claim 7, wherein the thin layer comprises chemically-applied nickel.

10. A control device according to claim 5, wherein the layer has a thickness between 5 and 30 $\mu$m.

11. A control device according to claim 9, wherein the layer has a thickness between 5 and 30 $\mu$m.

12. A control device according to claim 11, wherein the layer has a thickness of approximately 10 $\mu$m.

13. A control device according to claim 1, comprising:

a curable filling compound molded between the armature and the first lever while pressing the armature against the magnetic core.

14. A control device according to claim 4, comprising:

a curable filling compound molded between the armature and the first lever while pressing the armature against the magnetic core.

15. A control device according to claim 8, comprising:

a curable filling compound molded between the armature and the first lever while pressing the armature against the magnetic core.

* * * * *